US005577542A

United States Patent [19]

Hung

[11] Patent Number: 5,577,542

[45] Date of Patent: Nov. 26, 1996

[54] SLAT CARRIER FOR VERTICAL VENETIAN BLIND

[76] Inventor: Tien-Szu Hung, No. 267, Sec. 4, Chang Shui Road, Chi Fuh Township, Chang Hua Hsien, Taiwan

[21] Appl. No.: 565,473

[22] Filed: Nov. 30, 1995

Related U.S. Application Data

[63] Continuation-in-part of Ser. No. 314,106, Sep. 28, 1994, abandoned.

[51] Int. Cl.[6] ..... E06B 9/38

[52] U.S. Cl. ..... 160/177; 160/900

[58] Field of Search ..... 160/177 V, 176.1 V, 160/168.1 V, 900, 172 V, 173 V

[56] References Cited

U.S. PATENT DOCUMENTS 4,350,197 9/1982 Haller ..... 160/176.1 V X
4,799,527 1/1989 Villoch et al. ..... 160/900 X
5,054,535 10/1991 Rozon ..... 160/176.1 V X
5,067,544 11/1991 Spohr et al. ..... 160/177 V

*Primary Examiner*—David M. Purol
*Attorney, Agent, or Firm*—Pro-Techtor International

[57] ABSTRACT

A slat carrier for vertical Venetian blind includes a main body provided with an axial hole in which a spur gear and an annular gear are received such that the spur gear is engageable with the annular gear, which is provided with a center hole into which a rotating shaft is fitted. The main body is further provided with an upright hole in which a slat hanging body is fastened pivotally such that an arresting body of the slat hanging body is fastened with a disk gear having parallel teeth engageable with parallel teeth of the spur gear so as to facilitate an angular adjustment of the slat.

1 Claim, 3 Drawing Sheets

SLAT CARRIER FOR VERTICAL VENETIAN BLIND

This application is a continuation-in-part application of my previous application Ser. No. 08/314,106, filed Sep. 28, 1994, now abandoned.

FIELD OF THE INVENTION

The present invention relates generally to a vertical Venetian blind, and more particularly to a slat carrier for the vertical Venetian blind.

BACKGROUND OF THE INVENTION

As shown in FIG. 5, a prior art slat carrier 10 of a vertical Venetian blind comprises a main body 11 provided at the center of the upper portion thereof with a slot 12. Located under the slot 12 are two through holes 13 in which a draw cord is received respectively. The main body 11 is further provided at the center of the lower portion thereof with a rectangular seat slot 14 in which a spur gear 15 is disposed such that the spur gear 15 is pivoted to the upper end of a slat hanging body 16. Located at the center of the main body 11 is an axial hole 17 in which a rotating shaft 18 is received in such a manner that the teeth of the rotating shaft 18 mesh with the teeth of the spur gear 15.

The adjustment of the angular position of the slat is attained by the slat hanging body 16, which can be caused to rotate by turning the rotating shaft 18 which in turn actuates the spur gear 15. The actuation of the spur gear 15 results in the rotation of the slat hanging body 16 whose upper end is pivoted with the spur gear 15.

Such a prior art slat carrier assembly as described above has inherent shortcomings, which are expounded explicitly hereinafter.

The rotating shaft 18 can not be made economically in view of the fact that it is technically difficult to make the rotating shaft 18 which is provided with teeth capable of meshing with the spur gear 15 with precision. As a result, the angular positions of all slat hanging bodies 16 of the vertical Venetian blind can not be adjusted uniformly, In other words, all slats of the vertical Venetian blind can not be fastened with the slat hanging bodies 16 in a uniform manner. In addition, the rotating shaft 18 is not compatible with the spur gears made by various manufacturers.

The angular adjustment of each slat of the vertical Venetian blind is limited by the spur gear 15 such that the slat can be adjusted only in a range of about 180 degrees. Moreover, the extent to which each slat can be adjusted angularly is directly proportional to the size of the spur gear 15. As a result, the slat carrier 10 of the prior art can not be effectively reduced in size. In other words, the material cost of the slat carrier 10 of the prior art is relatively high. It is difficult to repair the slat carrier 10 of the prior art in view of the fact that the repair work calls for the separation of the spur gear 15 from the slat hanging body 16, and that the detached spur gear 15 can not be easily put back in with precision.

SUMMARY OF THE INVENTION

It is therefore the primary objective of the present invention to provide a vertical Venetian blind with a slat carrier which comprises a rotating shaft without teeth.

It is another objective of the present invention to provide a vertical Venetian blind with a slat carrier enabling all slats to be adjusted in a uniform manner within an angular range of 360 degrees, without regard to the manner in which the spur gears mesh with the slat hanging bodies.

It is still another objective of the present invention to provide a vertical Venetian blind with a slat carrier which is so compact as to take up little space in the headrail of the vertical Venetian blind.

It is still another objective of the present invention to provide a vertical Venetian blind with a slat carrier which can be repaired or replaced easily.

It is still another objective of the present invention to provide a vertical Venetian blind with a slat carrier which comprises an adjustment rod fastened with the lower end of the slat hanging body to facilitate the angular adjustment of the slats.

In keeping with the principle of the present invention, the foregoing objectives of the present invention are attained by a slat carrier, which comprises a main body provided with a stepped axial hole which is in turn provided in the outer edge thereof with two tenons for locating a spur gear and an annular gear, which are engageable with each other. The annular gear is provided with a center hole into which a rotating shaft of any cross sectional shape can be fitted. The main body is further provided with an upright hole in which a slat hanging body is fastened pivotally such that an arresting body of the slat hanging body is fastened with a disk gear having teeth engageable with teeth of the spur gear, so as to facilitate an angular adjustment of the slats.

The foregoing objectives, features and advantages of the present invention will be more readily understood upon a thoughtful deliberation of the following detailed description of the present invention in conjunction with the accompanying drawings.

DETAILED DESCRIPTION OF THE INVENTION

Figure 1:
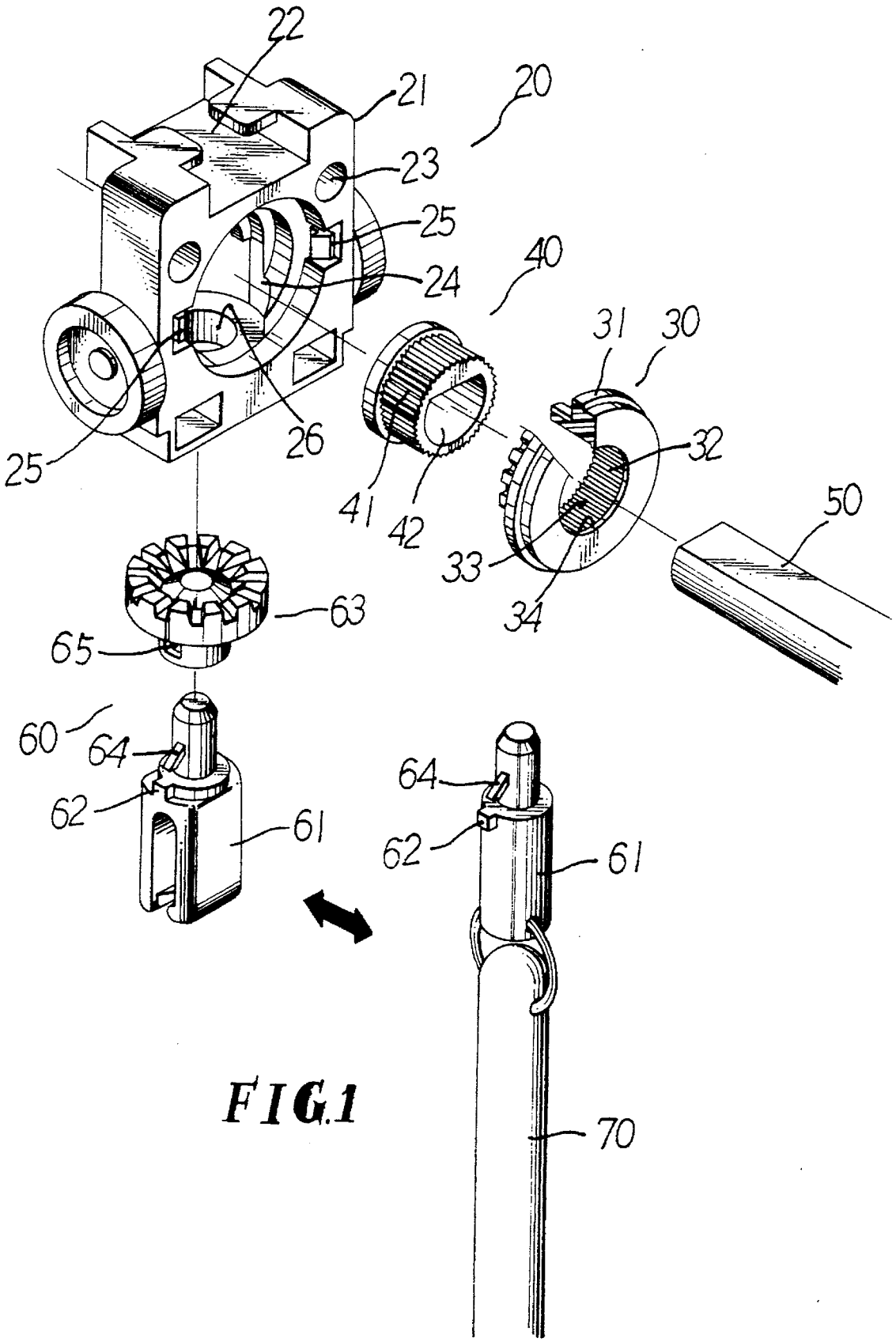
FIG. 1 shows an exploded view of a slat carrier assembly of the present invention.
Figure 2:
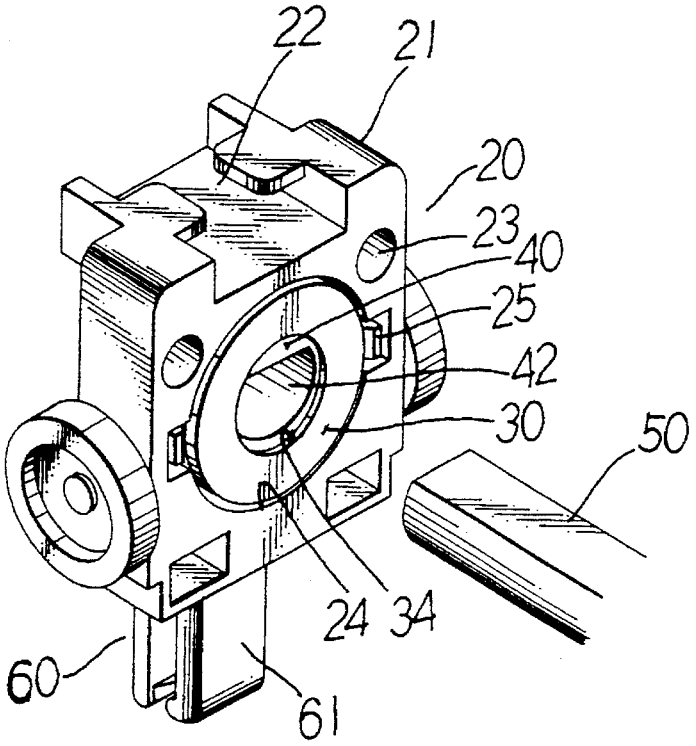
FIG. 2 shows a perspective view of the slat carrier assembly of the present invention.
Figure 3:
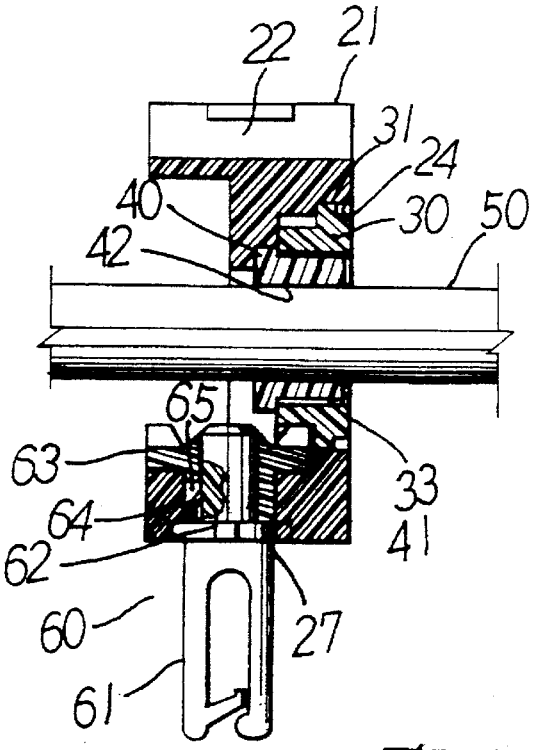
FIG. 3 shows a sectional view of the slat carrier assembly of the present invention.
Figure 4:
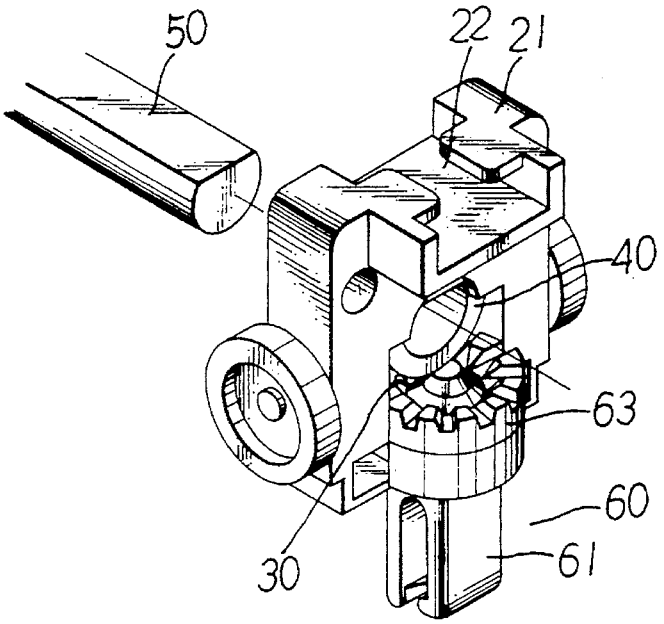
FIG. 4 shows a front elevational view of the slat carrier assembly of the present invention.
Figure 5:
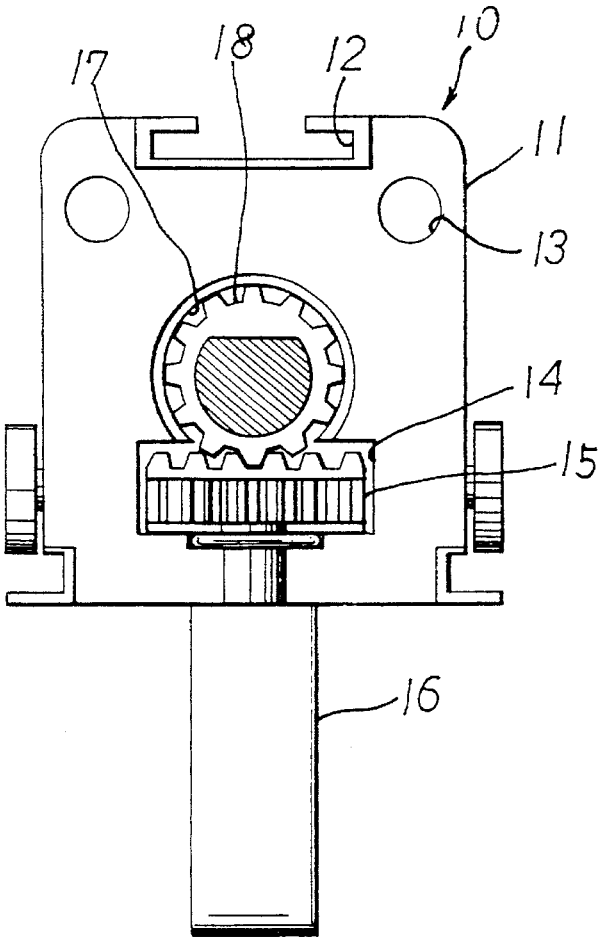
FIG. 5 shows a front view of a slat carrier assembly of the prior art.

As shown in FIGS. 1 and 2, a slat carrier 20 embodied in the present invention comprises a main body 21 provided in the upper portion thereof with a slot 22 and two through holes 23 for receiving a draw cord. The main body 21 is further provided with a stepped axial hole 24 which is in turn provided at the outer edge thereof with two tenons 25 opposite in location to each other. A spur gear 30 is fitted into the axial hole 24 such that a flange 31 of the spur gear 30 is retained by the two tenons 25. The spur gear 30 is provided with a center hole 32 having on the hole wall thereof a plurality of parallel teeth 33. Located at the edge of the outer end of the center hole 32 is a locating flange 34, which serves to locate an annular gear 40 in such a manner that the parallel teeth 41 located on the outer surface of the annular gear 40 mesh with the parallel teeth 33 of the center hole 32 of the spur gear 30. The annular gear 40 is rotatable in relation to the spur gear 30.

The annular gear 40 is provided axially with a receiving hole 42 to receive therein a rotating shaft 50 of any cross sectional profile. The main body 21 is still further provided in the underside thereof with an upright hole 26 having an axis perpendicular to the axis of the axial hole 24. The upright hole 26 is provided at the lower end thereof with a pivoting portion 27 to which a slat hanging body 60 is pivoted. The slat hanging body 60 comprises a slat holding apparatus 61 and a disk gear 63. as shown in FIG. 1 The slat holding apparatus 61 is provided on the top thereof with a locating projection 62 capable of cooperating with the pivoting portion 27 so as to locate the slat hanging body 60. The locating projection 62 is provided thereon with an arresting piece 64 for reinforcing the effect of fastening the slat hanging body 60. The slat hanging apparatus 61 is joined with the disk gear 63 such that the arresting piece 64 is retained in reverse direction in a retaining slot 65 of the disk gear 63. The slat hanging body 60 is fastened to the main body 21 such that the disk gear 63 of the slat hanging body 60 is received in the upright hole 26 of the main body 21, and that the parallel teeth 67 of the disk gear 63 mesh with the spur gear 30.

It is readily apparent that the spur gear 30 is engageable with the annular gear 40 as well as the disk gear 63 of the slat hanging body 60. As a result, the rotational motion of the rotating shaft 50 actuates the spur gear 30, the annular gear 40 and the disk gear 63. The rotation of the disk gear 63 can bring about a rotation of the slat hanging body 60, thereby resulting in a rotation of the slat within an angular range of 360 degrees.

The annular gear 40 is fitted into the spur gear 30 such that a motion can be transmitted from the annular gear 40 to the spur gear 30, and that the annular gear 40 is rotatable in relation to the spur gear 30.

The slat carrier 20 of the present invention can be made compact in view of the fact that the axial hole 24 and the upright hole 26 are arranged centrally in the main body 21 of the slat carrier assembly 20, and that the spur gear 30, the annular gear 46, the rotating shaft 50 and the disk gear 63 are all disposed centrally in the main body 21 of the slat carrier 20. As a result, the material cost of the slat carrier 20 of the present invention is relatively low.

The slat carrier 20 of the present invention can be assembled easily by virtue of the fact that the spur gear 30 and the annular gear 40 are held securely in place in the axial hole 24 by means of tenons 25, and that the disk gear 63 can be set up easily to mesh with the spur gear 30 without any additional work of checking. As a result, the repair work of the slat carrier assembly 20 of the present invention is made relatively easy.

As shown in FIG. 1, the slat hanging body 60 is fastened at the lower end thereof with an adjustment rod 70. In the meantime, the slat hanging body 60 is provided with the locating projection 62 engageable with the pivoting portion 27 and is further provided with the arresting body 64 which is retained in the retaining slot 64 without difficulty. The parallel teeth 67 of the disk gear 63 mesh with the spur gear 30.

The embodiment of the present invention described above is to be regarded in all respects as merely illustrative and not restrictive. Accordingly, the present invention may be embodied in other specific forms without deviating from the spirit thereof. The present invention is therefore to be limited only by the scopes of the following appended claims.

What is claimed is:

1. A slat carrier for vertical Venetian blind, which comprises:

a main body provided with a slot, two through holes, an axial hole having on an outer edge thereof two retaining tenons opposite to each other, and an upright hole having an axis perpendicular to an axis of said axial hole and having at one end thereof a pivoting portion;

a spur gear provided with a flange, a center hole having on an inner wall thereof a plurality of parallel teeth, said center hole further having at one end thereof a locating flange, said spur gear being received in said axial hole of said main body such that said flange of said spur gear is retained by said two retaining tenons of said main body;

an annular gear provided with a receiving hole, and parallel teeth which are located on an outer surface thereof and are engageable with said parallel teeth of said spur gear;

a rotating shaft received at one end thereof in said receiving hole of said annular gear to actuate said spur gear; and a slat hanging body comprising a slat holding apparatus and a disk gear having parallel teeth, said slat hanging body having a locating projection engageable pivotally with said pivoting portion of said main body such that said disk gear of said slat hanging body is received in said upright hole of said main body, and that said parallel teeth of said disk gear mesh with said spur gear, said slat hanging body further having an arresting body engageable with a retaining slot of said disk gear.

* * * * *